US007810563B2

(12) United States Patent
Buijse et al.

(10) Patent No.: US 7,810,563 B2
(45) Date of Patent: Oct. 12, 2010

(54) METHOD OF CONTROLLING WATER CONDENSATION IN A NEAR WELLBORE REGION OF A FORMATION

(75) Inventors: Marten Adriaan Buijse, Rijswijk (NL); Michael Zvi Golombok, Rijswijk (NL); Antoon Peter Gerardus Van Heel, Rijswijk (NL); Johannes Gerhardus Maas, Rijswijk (NL); Hendrik Martinus Wentinck, Rijswijk (NL); Marcus Stefanus Welling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 32 days.

(21) Appl. No.: 12/373,493

(22) PCT Filed: Jul. 12, 2007

(86) PCT No.: PCT/EP2007/057188

§ 371 (c)(1),
(2), (4) Date: Jan. 12, 2009

(87) PCT Pub. No.: WO2008/006880

PCT Pub. Date: Jan. 17, 2008

(65) Prior Publication Data

US 2009/0242204 A1 Oct. 1, 2009

(30) Foreign Application Priority Data

Jul. 14, 2006 (EP) ..... 06117239

(51) Int. Cl.
*E21B 43/12* (2006.01)

(52) U.S. Cl. ..... 166/250.07; 166/279; 166/300; 166/302; 166/370

(58) Field of Classification Search ..... None
See application file for complete search history.

(56) References Cited

U.S. PATENT DOCUMENTS

| | | | | |
|---|---|---|---|---|
| 3,032,499 | A | 5/1962 | Brown | 252/8.55 |
| 5,127,457 | A | 7/1992 | Stewart et al. | 166/306 |
| 6,655,221 | B1 * | 12/2003 | Aspelund et al. | 73/861.04 |
| 2007/0000663 | A1 * | 1/2007 | Kelley | 166/268 |

OTHER PUBLICATIONS

M.K.R., Panga, et al : "Wettability Alteration for Water Block Prevention in High Temperature Gas Wells", SPE 100182, Jun. 12, 2006, pp. 1-13.

Agriawan, et al : "Predicting Water Condensation Around a Dry Gas Well to Prevent Water Blocking", Proceedings, Indonesian Petroleum Association, Annual Convention and Exhibition, Oct. 14, 2003, pp. 503-514.

Mahadevan, J., et al: Evaporative Clean-Up of Water-Blocks in Gas Wells, SPE94215, Society of Petroleum Engineers, 2005 SPE Production and Operations Symposium held in Oklahoma City, OK, USA, Apr. 17-19, 2005.

* cited by examiner

*Primary Examiner*—Zakiya W. Bates
(74) *Attorney, Agent, or Firm*—William E. Hickman

(57) ABSTRACT

A method for controlling water condensation in the pores of a near wellbore region of a permeable formation through which wet natural gas flows into an inflow section of an oil and/or gas production well, the method comprising controlling fluid transfer through the near wellbore region such that development of a water bank resulting from condensation of water in said region is inhibited or promoted. If the well is a gas production well then development of a water bank may be inhibited by controlling pressure drawdown, cyclic well shut in, fracturing and/or injection of heat generating and/or water transporting chemicals.

12 Claims, No Drawings

METHOD OF CONTROLLING WATER CONDENSATION IN A NEAR WELLBORE REGION OF A FORMATION

The present application claims priority of European Patent Application No. 06117239.1filed 14Jul.2006.

BACKGROUND OF THE INVENTION

The invention relates to a method of controlling water condensation in the pores of a near wellbore region of a permeable formation.

Condensation of hydrocarbons in gas-condensate reservoirs is well known in the industry (see e.g. SPE paper 30767 published by Exxon, and SPE papers 30766 and 36714 published by Shell). The condensation of the hydrocarbons causes a liquid zone to be formed in the reservoir close to the well bore. This liquid is understood as acting to hamper gas flow, reducing the productivity of the well. It is assumed that this liquid drop out already occurs iso-thermally. SPE paper 94215 discusses drying of a water block, assuming a negligible effect of Joule-Thomson. In line with other literature discussing water blocks in gas reservoirs, it is assumed that the water block is formed during drilling, by fluid invasion from the drill hole into the reservoir.

Well impairment is an important problem in oil and gas field engineering. It causes that more wells need to be drilled to achieve a certain field production rate. To reduce impairment, it may require additional investment into fracturing jobs and/or underbalanced drilling. Increased investment cost may even prevent development of fields in an area believed to suffer frequently of flow impaired wells.

The method according to the preamble of claim 1 is known from SPE paper 100182 "Wettability alteration for Water Block Prevention in High-Temperature Gas Wells" presented by M. K. R. Panga et al at the SPE Europec/AEGA Annual Conference held in Vienna from 12 to 15 Jun. 2006. This paper describes the development of a chemical system for water block prevention in gas/condensate wells. The chemical system alters the formation wettability thereby decreasing the capillary forces and enhancing the clean up of trapped water at low drawdown pressures. Placement of such a chemical system is a complex procedure and the injected chemicals may be washed away. The SPE paper only teaches how to promote flux of water that is already present in the pores of the formation and not that the natural gas may contain water vapor which may condense in the formation in the vicinity of the well and how to inhibit or promote condensation of water vapour in the pores in the formation in the vicinity of the wellbore.

It is an object of the present invention to provide a method for controlling wet gas production such that development of a water bank resulting from condensation of water in the pores of a near wellbore region of a permeable formation is inhibited or promoted.

SUMMARY OF THE INVENTION

In accordance with the invention there is provided a method of controlling water flux in the pores of a near wellbore region of a permeable formation through which pores wet natural gas flows into an inflow section of an oil and/or gas production well, the method comprising a step to control development of a water bank, characterized in that the step comprises inhibiting or promoting development of a water bank resulting from condensation of water in said region by controlling fluid transfer through said region by controlling the fluid pressure in the inflow region of the well.

The method according to the invention is based on the novel insight that a natural gas may comprise water vapor, which vapor may condense in a near wellbore region of the formation due to the cooling of the natural gas as a result of the expansion and pressure reduction in the near wellbore region, and that the condensation rate may be decreased or increased by controlling the fluid pressure in the pores the near wellbore region of the formation.

It is observed that SPE paper 100182 does not indicate that water may condense in the pores of the near wellbore region of the formation as a result of the cooling of the gas stream resulting from expansion of the gas and that such condensation may be inhibited or promoted by controlling the fluid pressure in this region.

Optionally, the fluid pressure in the inflow section of the well is controlled such that the fluid pressure in the pores in the near wellbore region of the gas bearing formation surrounding said inflow section is controlled relative to a calculated fluid pressure at which water condenses within the pores of said region.

The well may be a gas production well and fluid transfer through said the pores of said near wellbore region may be controlled such that development of a water bank resulting from condensation of water in said region is inhibited or promoted.

If the well is a gas production well then development of a water bank may be inhibited by controlling the fluid pressure in the inflow section such that the fluid pressure in the pores of the near wellbore region is maintained above the calculated fluid pressure at which water condenses within the pores of said region.

If the well is a gas production well then it is preferred to maintain during normal well production the fluid pressure in the pores of the near wellbore region below the calculated fluid pressure at which water condenses within said pores.

Optionally, gas production from a wet gas production well is cyclically interrupted during a predermined interval of time, of which the duration is selected such that during said interval the fluid pressure in the pores rises to above the calculated fluid pressure at which water condenses within the pores, thereby permitting at least part of a water bank that may be developed in the pores of said region during normal well production to evaporate.

Optionally, heat and/or chemicals are injected into the pores of said near wellbore region of the permeable formation in order to evaporate, move and/or remove the waterbank.

Such chemicals may be selected from the group of heat generating chemicals, foaming chemicals, water-phobic chemicals, pH changing chemicals, such as $CO_2$ and HCl, substances which change interfacial tensions of the water-gas-rock interfaces such that viscous stripping of water and/or spreading of water onto the rock is promoted. The chemicals may be injected via chemical injection wells that may be arranged in a birdcage shaped configuration around the production well in the manner as described in U.S. Pat. No. 5,127,457.

If the formation in said near wellbore region comprises clay then swelling of clay may be inhibited by injection of brine, mineral dissolving substances and/or pH controlling chemicals.

Optionally the formation of a water bank due to water condensation may be inhibited by fracturing the formation in said region.

In an alternative embodiment of the method according to the invention the well is an oil production well which traverses a wet gas containing region and fluid transfer through said region is controlled such that development of a water bank resulting from condensation of water in said region is promoted.

If the well is a crude oil and wet natural gas producing well then the oil gas ratio of the produced multiphase well effluent mixture may be increased by inhibiting influx of gas from said near wellbore region into the well by promoting formation of a water bank within said near wellbore region.

It is observed that in this specification and accompanying claims the term wet gas refers to natural gas which contains water.

These and other features, advantages and embodiments of the method according to the invention are described in the accompanying claims, abstract and the following detailed description of preferred embodiments of the method according to the invention.

DESCRIPTION OF PREFERRED EMBODIMENTS OF THE INVENTION

Analytical calculations and simulations with a reservoir simulation computer program show surprisingly that during wet gas production from an underground reservoir, water may condense in the formation in the neighbourhood of the well. Water is present in the gas phase, because often also a water liquid phase is present in underground formation and the liquid will bring about a partial water vapour pressure. Typically, the molar fraction of water in the gas is in the order of less than 1%. During production, the composition of the gas phase is affected by changes in pressure and temperature. Notably, the condensation effect is enhanced by cooling due to the so-called Joule-Thomson effect, and/or by cooling due to adiabatic gas expansion. The research also indicates that invasion of drilling fluids from the drilling hole into the formation may be much less than conventionally assumed in the industry.

Based on this new understanding of how a water block may come about the following four groups of procedures have been developed that are described in more detail below:

I) Procedures to prevent or reduce the formation of such a water zone in the reservoir near the well.

II) Procedures to conduct diagnostics to test for or to monitor the formation and/or existence of such water zones;

III) Procedures to promote the formation of a water block to act as a flow diverter e.g. of gas in an oil field with a gas-cap and IV) Any combination of the above three procedures I-III.

I) Procedures to prevent/reduce water block resulting from formation of a water bank resulting from water condensation in a near wellbore region of a permeable formation surrounding an inflow region of a wet gas production well may include one or more of the following procedures:

- Limit pressure drawdown in an inflow region of a wet gas production well such that the fluid pressure in the pores of a near wellbore region of a permeable formation surrounding the inflow region is above a pressure at which a water bank resulting from water condensation is formed.
- Halt wet gas production intermittently to allow the gas-liquid to re-equilibrate, bringing about a reduction of the size/concentration/impact of the water block.
- Before producing a wet gas production well: Injection of substances to change properties of the formation to facilitate water transport towards the well. Examples of such substances are water-phobic chemicals, or pH changing chemicals like $CO_2$, HCl. Carrier of such substances may be gases $CO_2$, $N_2$, $CH_4$, $Cl_2$; or liquids, water, brine, HCl, methanol, or a combination of gas and liquids.
- Injection of substances to change interfacial tensions of the brine-gas-rock system, to promote "viscous stripping" of the water, or spreading of the water onto the rock to increase transport towards the well and/or to increase the gas throughput directly.
- Injection of substances may be conducted using "loaded" bullets in the perforation gun.
- Injection of substances that change the viscosity of the water in gas or liquid phase or change the vapour pressure of the water phase mitigating the (re)moval of the waterbank.
- Injection of substances after some production has taken place at irregular time intervals or at regular intervals, similar to so-called huff-and-puff operations.
- Variation of huff-and-puff that maintains a minimum gas flow to facilitate (re-) evaporation of the water block.
- Injection of foaming surfactants to increase the effect of drag forces by the gas when flowing towards the well in an attempt to reduce the size and/or impact of the water zone.
- Injection of chemicals to generate heat in the reservoir.
- Send heat into the reservoir by a carrier fluid.
- Send heat into the reservoir by a conductive process, by using a heat source in the well.
- Send heat into the reservoir by a convective process, by injection and/or subsequent withdrawal of warm and/or cold substances.
- Send heat into the reservoir by transmitting electromagnetic (EM) and/or other radiofrequency(RF) waves into the reservoir, such that in particular any water is heated and evaporated.
- Maintain reduced draw-down after stimulation of the well e.g. with a fracturing or acid job.
- Optimise production versus shut-in periods, monitoring well performance including temperature and pressure response.
- Manage/reduce clay swelling that may be promoted by slower salinity water (condensing water will dilute the formation brine) by injection of brine, mineral dissolving substances, pH control.

II) Diagnostic tests and/or monitoring

- Run logging strings to detect the presence of a deep, possibly sweet water zone
- Conduct a seismic survey, or a form of tomography to detect and/or monitor the occurrence of a deep water zone.
- Use DTS technology to monitor formation of a water zone.
- Conduct operations to study sensitivity of the gas production with respect to water zone build-up, to optimise well performance.
- Monitor the presence of a water bank by means of electromagnetic and/or induced polarisation logging methods.

III) Promote water block for flow diversion

- Apply e.g. smart well technology to detect building-up of a water zone in one place e.g. along a horizontal hole; shutting that zone off and opening another zone
- Manage drawdown as to promote the formation of a water bank that may reduce gas flow in an oil reservoir, thereby increasing the oil-gas ratio in the producer.
- Exploit a self-healing effect that may come about when locally a water block occurs and flow is diverted. The blocked zone may then rejuvenate while the diverted flow may in its turn create locally a new water block.

IV) Any combination of the above described procedures I-III.

That which is claimed is:

1. A method of controlling water flux in the pores of a near wellbore region of a permeable formation through which pores wet natural gas flows into an inflow section of an oil and/or gas production well, the method comprising a step to control development of a water bank, characterized in that the step comprises inhibiting or promoting development of a water bank resulting from condensation of water in said region by controlling fluid transfer through said region by controlling the fluid pressure in the inflow region of the well;

wherein the well is a gas production well and fluid transfer through said the pores of said near wellbore region is controlled such that development of a water bank resulting from condensation of water in said region is inhibited or promoted.

2. The method of claim 1, wherein the fluid pressure in the inflow section of the well is controlled such that the fluid pressure in the pores in the near wellbore region of the gas bearing formation surrounding said inflow section is controlled relative to a calculated fluid pressure at which water condenses within the pores of said region.

3. The method of claim 2, wherein the well is a gas production well and development of a water bank is inhibited by controlling the fluid pressure in the inflow section such that the fluid pressure in the pores of the near wellbore region is maintained above the calculated fluid pressure at which water condenses within the pores of said region.

4. The method of claim 2, wherein the well is a gas production well in which during normal well production the fluid pressure in the pores of the near wellbore region is below the calculated fluid pressure at which water condenses within said pores and wherein gas production from the well is cyclically interrupted during a predetermined interval of time, of which the duration is selected such that during said interval the fluid pressure in the pores rises to above the calculated fluid pressure at which water condenses within the pores, thereby permitting at least part of a water bank that may be developed in the pores of said region during normal well production to evaporate.

5. The method of claim 2, wherein chemicals are injected into the pores of said near wellbore region of the permeable formation in order to evaporate, move and/or remove the waterbank.

6. The method of claim 5, wherein the chemicals consist of the group of heat generating chemicals, foaming chemicals, water-phobic chemicals, pH changing chemicals, substances which change interfacial tensions of the water-gas-rock interfaces such that viscous stripping of water, spreading of water onto the rock is promoted, or substances that change the viscosity of the water in gas or liquid phase or change the vapor pressure of the water phase.

7. The method of claim 6, wherein the pH changing chemicals comprise $CO_2$ or HCl.

8. The method of claim 5, wherein the formation in said near wellbore region comprises clay and swelling of clay is inhibited by injection of brine, mineral dissolving substances or pH controlling chemicals.

9. The method of claim 2, wherein the formation of a water bank due to water condensation is inhibited by fracturing the formation in said region.

10. The method of claim 2, wherein heat is injected into the pores of said near wellbore region of the permeable formation in order to evaporate, move and/or remove the waterbank.

11. The method of claim 1, wherein the well is an oil production well, which traverses a wet gas containing region and fluid transfer through said region is controlled such that development of a water bank resulting from condensation of water in said region is promoted.

12. The method of claim 11, wherein the well is a crude oil and wet natural gas producing well and the oil gas ratio of the produced multiphase well effluent mixture is increased by inhibiting influx of gas from said near wellbore region into the well by promoting formation of a water bank within said near wellbore region.

* * * * *